US006953190B2

(12) United States Patent
Shin

(10) Patent No.: US 6,953,190 B2
(45) Date of Patent: Oct. 11, 2005

(54) PAPER CARTRIDGE FOR PRINTING APPARATUS

(75) Inventor: Hwa-sung Shin, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 130 days.

(21) Appl. No.: 10/393,427

(22) Filed: Mar. 21, 2003

(65) Prior Publication Data

US 2003/0209851 A1 Nov. 13, 2003

(30) Foreign Application Priority Data

May 10, 2002 (KR) ..... 2002-25921

(51) Int. Cl.[7] ..... B65H 3/54
(52) U.S. Cl. ..... 271/170; 271/157
(58) Field of Search ..... 271/157, 170

(56) References Cited

U.S. PATENT DOCUMENTS 4,390,175 A * 6/1983 Takahashi ..... 271/157
4,406,448 A * 9/1983 Kulpa et al. ..... 271/160
4,754,961 A 7/1988 Tokuda et al.
4,852,869 A * 8/1989 Watanabe et al. ..... 271/126
5,096,182 A * 3/1992 Kashimura ..... 271/170
5,451,039 A * 9/1995 Adachi ..... 271/9.06
5,695,182 A 12/1997 Sekine
5,732,307 A * 3/1998 Yoshizuka et al. ..... 399/23
6,523,821 B2 * 2/2003 Kashiwagi et al. ..... 271/145
6,773,182 B2 * 8/2004 Yang ..... 400/624

FOREIGN PATENT DOCUMENTS

| | | |
|---|---|---|
| JP | 61-55031 | 3/1986 |
| JP | 7-17259 | 1/1995 |
| JP | 7-172592 | 7/1995 |
| JP | 7-267390 | 10/1995 |
| JP | 7-277534 | 10/1995 |
| JP | 10-17157 | 1/1998 |
| JP | 10-59555 | 3/1998 |
| JP | 2002-326724 | 11/2002 |

* cited by examiner

*Primary Examiner*—Donald P. Walsh
*Assistant Examiner*—Kenneth W. Bower
(74) *Attorney, Agent, or Firm*—Staas & Halsey LLP

(57) ABSTRACT

A paper cartridge for a printing apparatus includes a cartridge body; a pressure plate moving upward and downward in the cartridge body; a pick-up roller to pick up the paper stacked on the pressure plate; a spring to elastically bias the pressure plate toward the pick-up roller; a claw unit to support a front end of the paper stacked on the pressure plate and separate the paper picked up by the pick-up roller sheet by sheet; and a cover member pivotably disposed at the paper cartridge, to cover the paper stacked on the pressure plate to prevent the paper from being contaminated with foreign material such as dust.

13 Claims, 5 Drawing Sheets

PAPER CARTRIDGE FOR PRINTING APPARATUS

CROSS-REFERENCE TO RELATED APPLICATIONS

This application claims the benefit of Korean Application No. 2002-25921, filed May 10, 2002, in the Korean Intellectual Property Office, the disclosure of which is incorporated herein by reference.

BACKGROUND OF THE INVENTION

1. Field of the Invention

The present invention relates to a paper cartridge for a printing apparatus, and more particularly, to a paper cartridge removably mounted in a printing apparatus, to contain paper to print thereon and to supply the paper sheet by sheet.

2. Description of the Related Art

Generally, a printing apparatus such as a photocopier or a laser printer includes a paper cartridge to contain paper to be picked-up and supplied to a body of the printing apparatus. The paper cartridge is removably mounted in a body of the printing apparatus such that a pick-up unit supplies the paper contained in the paper cartridge sheet by sheet. Referring FIG. 1, a conventional paper cartridge has a pick-up roller 11 disposed in a cartridge body 10. A pressure plate 13 is disposed under the pick-up roller 11 and is capable of moving upward and downward. Between the pressure plate 13 and a bottom of the cartridge body 10 is disposed a spring 15. Due to a recovering force of the spring 15, the pick-up roller 11 and the pressure plate 13 come into contact with each other with a predetermined pressure. Accordingly, a predetermined pick-up force is exerted on the paper.

Also, the paper cartridge further includes a lever 17 to allow the pressure plate 13 to be separated from the pick-up roller 11, to stack the paper between the pick-up roller 11 and the pressure plate 13.

When the lever 17 is rotated clockwise (as shown in FIG. 1), a protrusion 17*a* of the lever 17 comes into contact with the pressure plate 13. The lever 17 moves the pressure plate 13 downward, as shown by the dashed line in FIG. 1, and stops the rotation. In this state, the paper is stacked between the pick-up roller 11 and the pressure plate 13. When the lever 17 rotates back to its original position after the paper is stacked, the pressure plate 13 moves upward by a recovering force of the spring 15. Accordingly, the paper comes into contact with the pick-up roller 11 with a predetermined pressure.

In the conventional paper cartridge as constructed above, the paper is stacked on the pressure plate 13 after the pressure plate 13 is separated from the pick-up roller 11 by the rotation of the lever 17. At this time, a user is required to return the lever 17 to the original position to keep a predetermined degree of pressure between the pick-up roller 11 and the pressure plate 13. If the user inadvertently does not return the lever 17 to the original position, the paper is not smoothly picked-up and thus a smooth printing operation cannot be obtained.

Also, since the lever 17 must be separately provided in the paper cartridge, there are difficulties and limitations in designing the paper cartridge.

Also, since the pressure plate 13 on which the paper is stacked is opened to the outside, the paper is easily contaminated with dust and dirt.

SUMMARY OF THE INVENTION

Accordingly, it is an object of the present invention to overcome the above problems in the prior art.

It is another object of the present invention to provide a paper cartridge for a printing apparatus capable of smoothly picking-up paper by varying a contact angle between the paper and a pick-up guide surface.

Additional objects and advantages of the invention will be set forth in part in the description which follows and, in part, will be obvious from the description, or may be learned by practice of the invention.

The foregoing and other objects are achieved by providing a paper cartridge for a printing apparatus to print on paper, including a cartridge body; a pressure plate to move upward and downward in the cartridge body, the paper being stacked thereon; a pick-up roller to pick up the paper stacked on the pressure plate; a spring to elastically bias the pressure plate toward the pick-up roller; a claw unit to support a front end of the paper stacked on the pressure plate and to separate the paper picked up by the pick-up roller sheet by sheet; and a cover member pivotably disposed at the cartridge body to cover the paper stacked on the pressure plate, to prevent the paper from being contaminated with a foreign material.

The paper cartridge may further include an association movement unit through which the cover member and the claw unit are moved in association with each other, the association movement unit to separate the pressure plate from the claw unit to allow the paper to be stacked on the pressure plate.

The association movement unit may include a first pivot lever connected to the pivot shaft of the cover member to rotate with the pivot shaft, and to move the pressure plate downward by contacting the pressure plate when the cover member is opened; and a second pivot lever pivotably disposed at the cartridge body, to rotate in contact with the downward moving pressure plate and to push the claw unit upward to thereby separate the pressure plate from the claw unit.

The paper cartridge may further include an automatic driving unit to automatically close the cover member when the pick-up roller is driven with the cover member being opened, to thereby return the pressure plate and the claw unit together.

The cover member may include a pivot shaft, and the automatic driving unit may include a first pivot lever disposed at the pivot shaft of the cover member and to rotate with the pivot shaft, to selectively press and move the pressure plate downward, the first pivot lever having gear teeth formed along an external circumference thereof; an idle gear rotatably disposed at the cartridge body and selectively engaged with the gear teeth of the first pivot lever depending on a rotation position of the first pivot lever; and a main gear to transmit a driving force of the pick-up roller to the idle gear.

The main gear may serve as a clutch to selectively block the driving force of the pick-up roller from being transmitted to the idle gear when a torque occurs in the idle gear to cause the idle gear to rotate in an opposite direction to the rotation direction of the pick-up roller.

The main gear may include an inner gear connected to the rotary shaft of the pick-up roller; and an outer gear connected to an outer side of the inner gear and engaged with the idle gear, wherein the inner gear and the outer gear are rotated together with each other due to a friction occurring therebetween, or only the inner gear is rotated when the outer gear is subject to a larger torque than the friction, thereby preventing the driving force from being transmitted to the idle gear.

The outer gear may have a groove formed along an inner circumference thereof, a curvature radius of the groove repeatedly increasing and decreasing in a rotation direction, and the inner gear has a resilient member resiliently deformed by contact with the groove when the inner gear rotates, and due to a friction occurring between the resilient member and the groove, the inner gear and the outer gear are rotated with each other.

The gear teeth of the first pivot lever may be engaged with the idle gear when the cover member is opened, and the gear teeth are disengaged from the idle gear when the cover member is closed.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
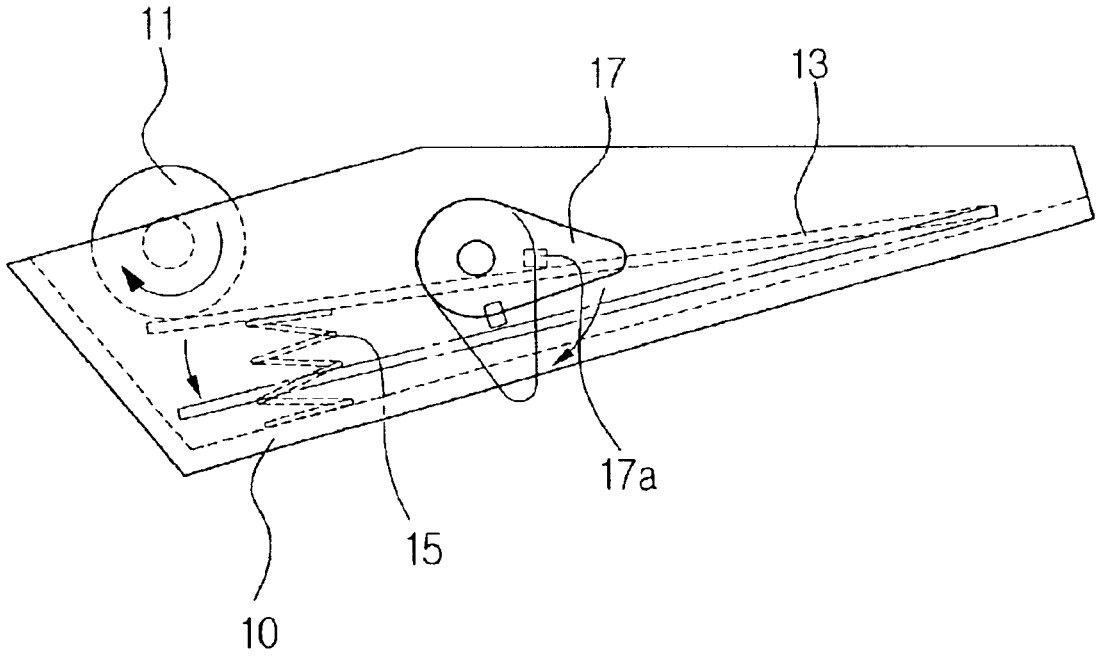
FIG. 1 (PRIOR ART)
FIG. 1 is a partial sectional view showing a paper cartridge for a conventional printing apparatus.

Reference will now be made in detail to the present preferred embodiments of the present invention, examples of which are illustrated in the accompanying drawings, wherein like reference numerals refer to like elements throughout.

Figure 2:
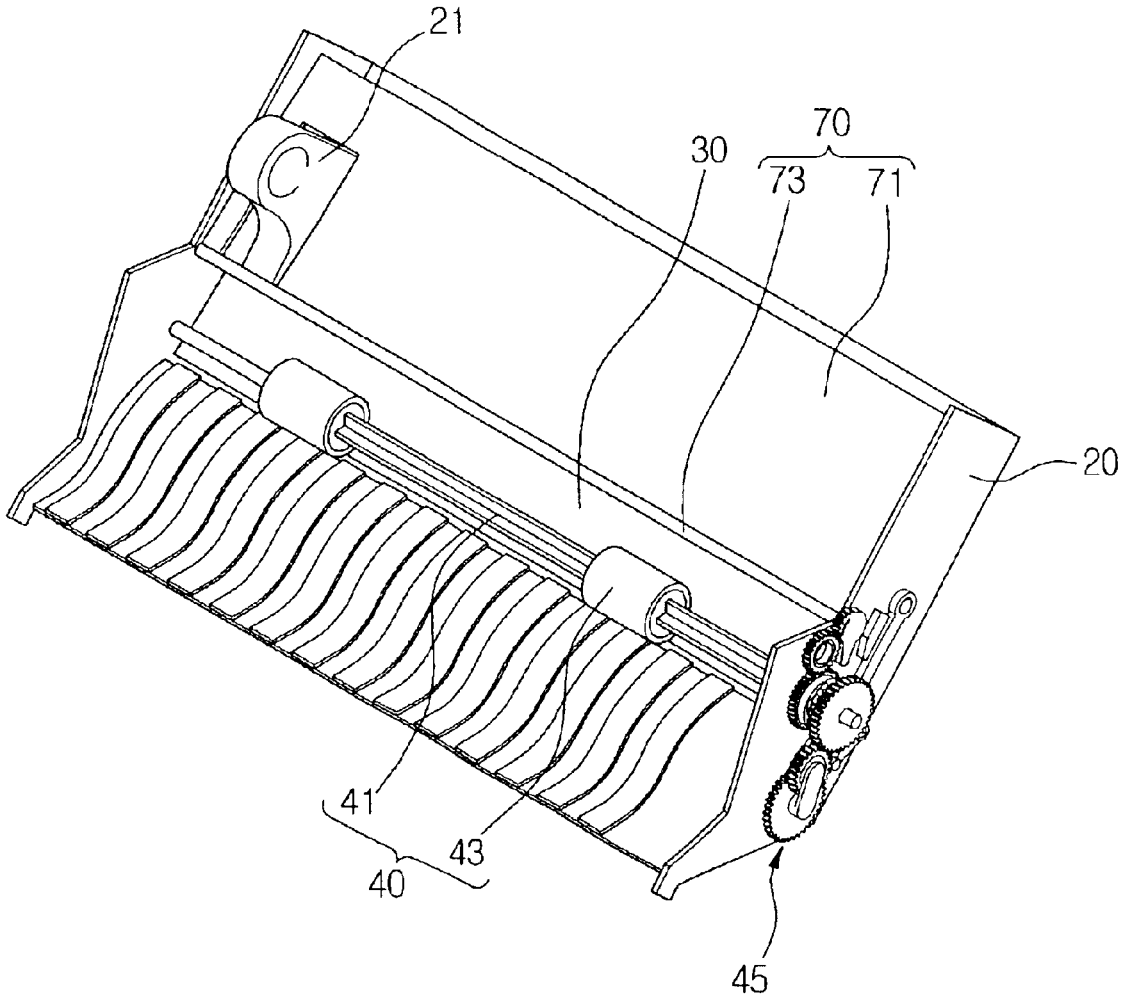
FIG. 2 is a perspective view showing a paper cartridge for a printing apparatus according to an embodiment of the present invention.
Figure 3:
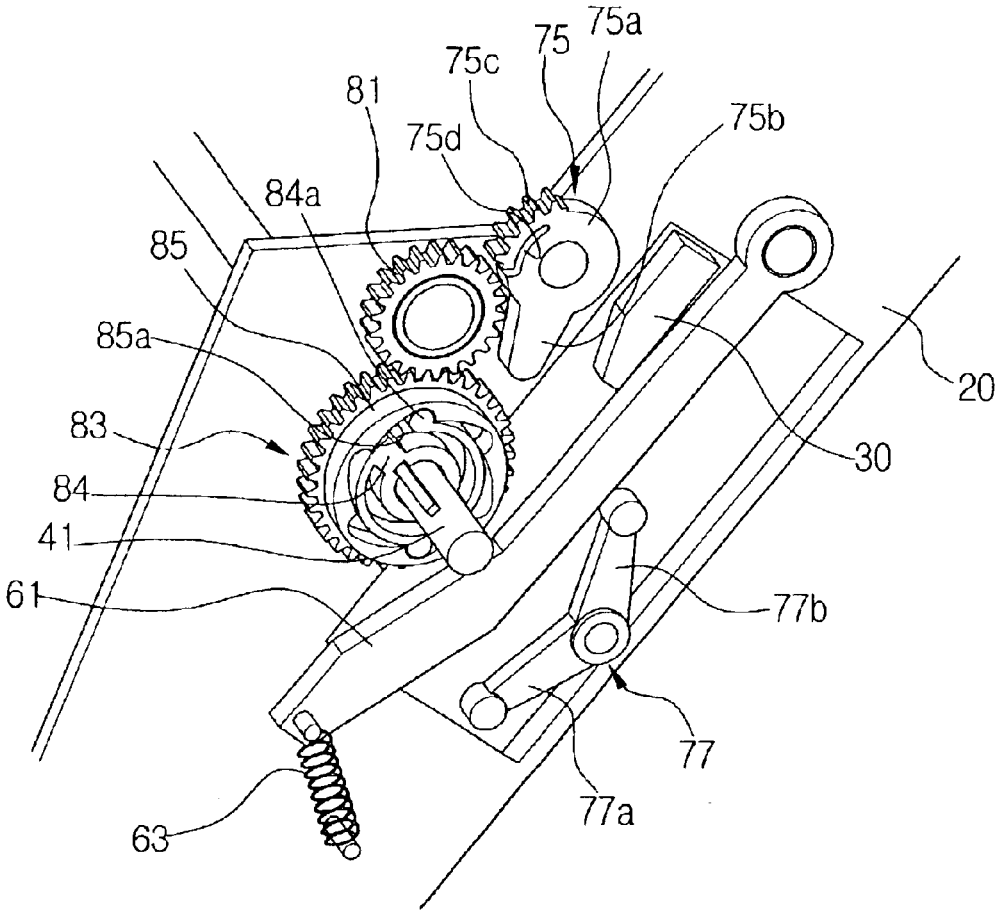
FIG. 3 is a partially enlarged view showing a portion of FIG. 2.
Figure 4:
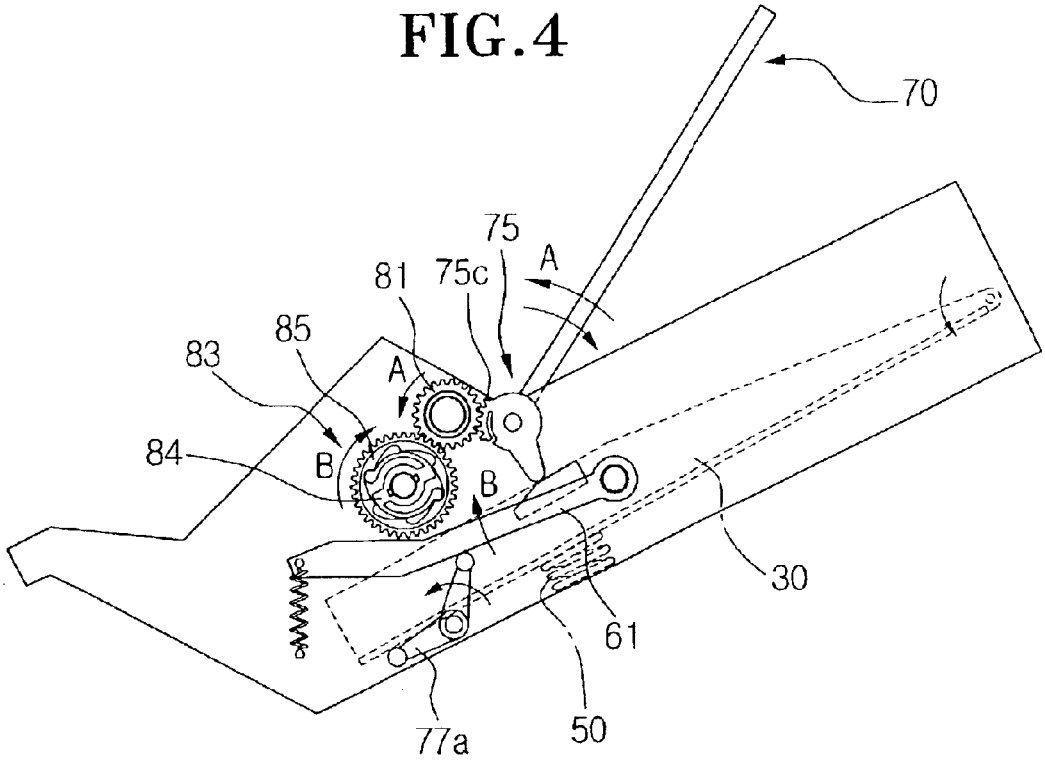
FIGS. 4 and 5 are schematic side sectional views showing the paper cartridge of FIG. 2 in order to explain the operation thereof.

Referring to FIGS. 2 through 4, a paper cartridge for a printing apparatus according to an embodiment of the present invention includes a cartridge body 20, a pressure plate 30 disposed in the cartridge body 20 and moving upward and downward, a pick-up roller 40 to pick up paper stacked on the pressure plate 30, a spring 50 to elastically bias the pressure plate 30 toward the pick-up roller 40, a claw unit to separate the paper picked up from the pressure plate 30 sheet by sheet, and a cover member 70 to protect the paper from dust and other contaminants.

The cartridge body 20 is mounted in the printing apparatus to supply the paper. The cartridge body 20 is provided with a paper guide 21 capable of sliding to align the paper stacked on the cartridge body 20. The paper guide 21 reciprocates in the cartridge body 20 in parallel with respect to a rotary shaft 41 of the pick-up roller 40, and aligns the stacked paper through manipulation by a user.

The pressure plate 30 receives the paper, and has one end hinged on the cartridge body 20 and the other end elastically biased toward the pick-up roller 40 by the spring 50 such that the pressure plate 30 can be moved upward and downward.

The spring 50 elastically biases the pressure plate 30 toward the pick-up roller 40 such that the paper stacked on the pressure plate 30 comes into contact with the pick-up roller 40 at a predetermined pressure. Accordingly, there is a predetermined friction between the paper and the pick-up roller 40. The predetermined friction allows the paper to be picked-up when the pick-up roller 40 rotates.

The pick-up roller 40 has the rotary shaft 41, both ends of which are connected with both side-walls of the cartridge body 20, and a plurality of roller bodies 43 disposed around the rotary shaft 41 and being spaced from each other by a predetermined distance. The roller bodies 43 are made of rubber similar to the rubber used in a general pick-up roller. The rotary shaft 41 rotates by a driving force that is transmitted from a printing apparatus body (not shown) via a driving force transmission gear 45.

The claw unit is to separate the paper picked up from the pressure plate 30 sheet by sheet. The claw unit includes a claw lever 61 having one end pivotably connected with a sidewall of the cartridge body 20, and a spring 63 to elastically bias the other end of the claw lever 61 downward, i.e., toward the pressure plate 30. The other end of the claw lever 61 is connected to the spring 63 and supports a front end of the paper stacked on the pressure plate 30 to pick up the paper sheet by sheet.

The cover member 70 protects the paper stacked on the pressure plate 30 from foreign material such as dust. The cover member 70 includes a cover body 71 shaped in a plate and a pivot shaft 73 disposed at an end of the cover body 71. Both ends of the pivot shaft 73 are rotatably supported on both sidewalls of the cartridge body 20, respectively. In order to stack the paper on the pressure plate 30, the user first pivots open the cover member 70. After stacking the paper on the pressure plate 30, the user closes the cover member 70 by pivoting the same to an original position.

Also, the paper cartridge further includes an association movement unit to move the cover member 70 and the claw unit in association with each other. When the cover member 70 is opened to stack the paper on the pressure plate 30, the pressure plate 30 is separated from the claw unit 60 by the association movement unit. The association movement unit includes a first pivot lever 75 connected to the pivot shaft 73 and a second pivot lever 77 pivotably disposed at the cartridge body 20. The first pivot lever 75 has a lever protrusion 75*b* extending from a lever body 75*a* to a predetermined distance. The lever protrusion 75*b* rotates in the 'A' direction when the cover member 70 is opened and comes into contact with the pressure plate 30. Accordingly, the pressure plate 30 is moved downward.

The second pivot lever 77 is pivotably disposed at a sidewall of the cartridge body 20. The second pivot lever 77 has a first lever protrusion 77*a* and a second lever protrusion 77*b* that are different from each other in length. The first lever protrusion 77*a* is rotated in the 'A' direction by the pressure plate 30, descending in association with the rotation of the first pivot lever 75. Rotating in the 'A' direction, the second lever protrusion 77*b* pushes the claw lever 61 upward. Then, the claw lever 61 and the pressure plate 30 are separated from each other by ascending and descending, respectively.

Also, the paper cartridge further includes an automatic driving unit to automatically close the cover member 70 to return the pressure plate 30 and the claw unit 60 to their original position when the pickup roller 40 is driven with the cover member 70 open. The automatic driving unit includes gear teeth 75*c* formed along an outer circumference of the first pivot lever 75, an idle gear 81 rotatably disposed at the cartridge body 20, and a main gear 83 disposed at the rotary shaft 41 of the pick-up roller 40.

The gear teeth 75*c* are formed along a predetermined edge of the lever body 75*a* of the first pivot lever 75. Accordingly, the gear teeth 75*c* are engaged with or disengaged from the idle gear 81 depending on a position of the rotated first pivot lever 75. That is, the gear teeth 75*c* are engaged with the idle gear 81 when the cover member 70 is opened and are disengaged from the idle gear 81 when the cover member 70 is closed. Also, in an area adjacent to the gear teeth 75*c* is formed a slit 75*d* of a predetermined length to provide the gear teeth 75*c* with resistance. Due to the presence of the slit 75*d*, the gear teeth 75*c* are smoothly engaged with or disengaged from the idle gear 81.

The idle gear 81 is interposed between the first pivot lever 75 and the main gear 83. The idle gear 81 is engaged with the main gear 83. Also, the idle gear 81 is selectively engaged with the gear teeth 75*c* to transmit or disconnect a driving force.

When the pick-up roller 40 is driven with the cover member 70 open, the main gear 83 transmits a driving force of the pick-up roller 40 to the cover member 70 via the idle gear 81 such that the cover member 70 is automatically closed by the driving force. Also, when the idle gear 81 is subjected to a predetermined torque, the main gear 83 serves as a clutch that selectively blocks a transmission of the driving force from the rotary shaft 41 of the pick-up roller 40 to the idle gear 81, depending on a magnitude of the predetermined torque. For this, the main gear 83 has an inner gear 84 fastened to the rotary shaft 41 of the pick-up roller 40 and an outer gear 85 connected to the inner gear 84 to receive the inner gear 84. The outer gear 85 has gear teeth formed on an outer circumference thereof and is engaged with the idle gear 81.

A predetermined friction occurs at a contact portion where the inner gear 84 and the outer gear 85 contact each other. Due to the friction, the inner gear 84 and outer gear 85 are rotated together with each other. Also, when there is a torque that affects the outer gear 85 more than the friction, the inner gear 84 overcomes the friction and independently slides and rotates. Accordingly, the inner gear 84 performs the clutch function. To achieve this result, the outer gear 85 has a groove 85*a* formed along an inner circumference thereof. A curvature radius of the groove 85*a* repeatedly increases and decreases in a rotation direction. Also, the inner gear 84 has a pair of resilient members 84*a* to resiliently contact the groove 85*a*. The resilient members 84*a* are symmetrical and their ends contact the groove 85*a* to generate the friction. The resilient members 84*a* are compressed and recovered while sliding on the groove 85*a*, to thereby maintain the predetermined friction.

The operation of the paper cartridge for the printing apparatus according to the embodiment of the present invention will be described hereinbelow.

As shown in FIG. 4, when the cover member 70 is raised, the first pivot lever 75 rotates in the 'A' direction. Then, the second lever protrusion 75*b* comes into contact with the pressure plate 30 and moves the same downward. Accordingly, the pressure plate 30 is separated from the pick-up roller 40. Also, the pressure plate 30 comes into contact with the first lever protrusion 77*a* by being moved downward, and accordingly, the first lever protrusion 77*a* is rotated. Then, the second lever protrusion 77*b* is also rotated and comes into contact with the claw lever 61. The claw lever 61 is rotated in the 'B' direction and separated from the pressure plate 30. As described above, when the cover member 70 is opened, the pressure plate 30 is moved downward, and in association with the movement of the pressure plate 30, the claw lever 61 is moved upward. Accordingly, it becomes easy to stack the paper on the pressure plate 30. When the cover member 70 is closed after the paper is stacked on the pressure plate 30, the pressure plate 30 and the claw lever 61 return to their original position.

Figure 5:
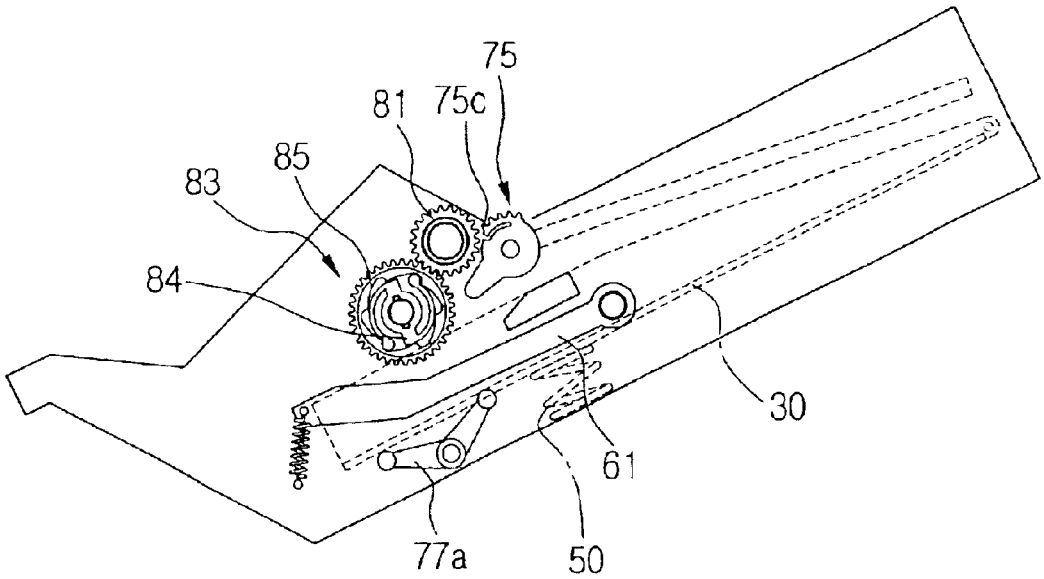

The printing operation may be performed with the cover member 70 being opened. When this happens, the pick-up roller 40 is rotated in the 'B' direction by the driving force transmitted from the printing apparatus body. Then, the inner gear 84 of the main gear 83 is rotated in the 'B' direction in association with the rotary shaft 41 of the pick-up roller 40. Due to the friction that occurs between the resilient members 84*a* of the inner gear 84 and the outer gear 85, the outer gear 85 is also rotated in the 'B' direction. Then, the idle gear 81 engaged with the main gear 83 is rotated to rotate the first pivot lever 75 in the 'B' direction. That is, the idle gear 81 is engaged with the gear teeth 75*c* of the first pivot lever 75 when the cover member 70 is opened, and accordingly, the first pivot lever 75 is rotated in accordance with the rotation of the idle gear 81. As a result, as shown in FIG. 5, the cover member 70 is moved in the 'B' direction to be closed. When the cover member 70 is closed, the idle gear 81 and the gear teeth 75*c* are disengaged from each other such that the driving force is not transmitted to the first pivot lever 75.

Alternately, the user may open the cover member 70 while the pick-up roller 40 is picking up the paper, rotating with the cover member 70 closed. When this happens, the first pivot lever 75 is rotated in the 'A' direction and the pressure plate 30 and the claw lever 61 are moved to the position shown in FIG. 4. Then, the idle gear 81 is rotated in the 'A' direction by the driving force transmitted from the main gear 83. In this state, when the gear teeth 75*c* of the first pivot lever 75 are engaged with the idle gear 81, the gear teeth 75*c* and the idle gear 81 are respectively subjected to a load in an opposite direction, such that the idle gear 81 stops rotating in the 'A' direction.

Figure 6:
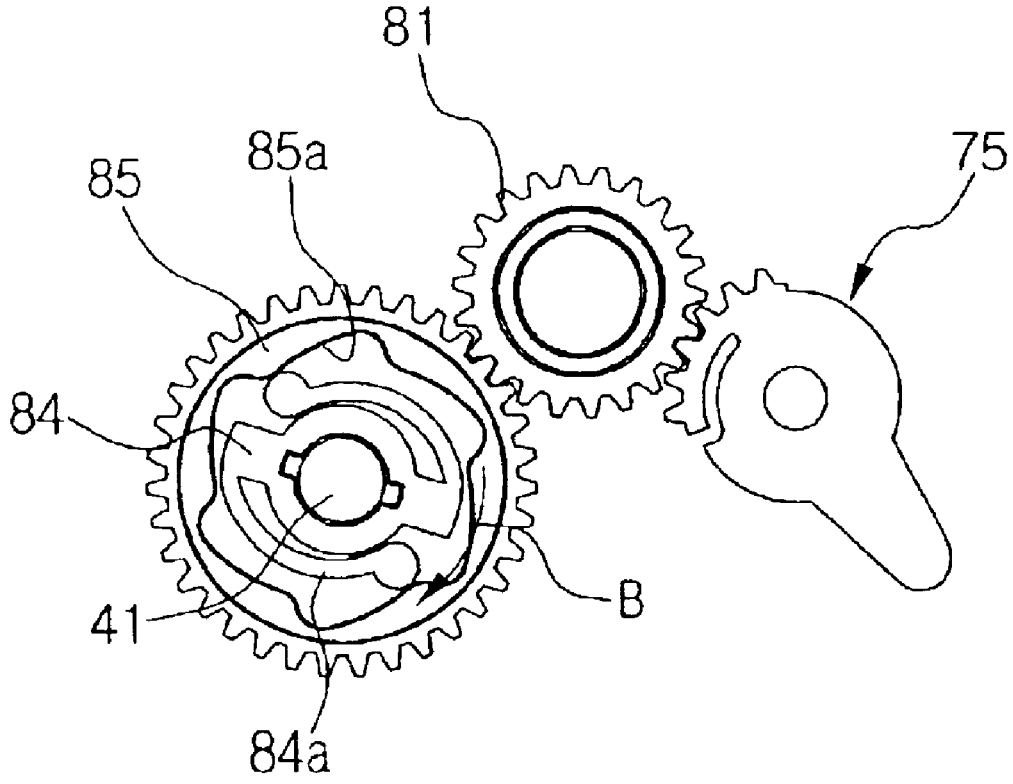
FIG. 6 is a schematic view showing a main gear of FIG. 2 to explain the operation thereof.

When the idle gear 81 stops its rotation, the outer gear 85 engaged with the idle gear 81 also stops rotating. Then, as shown in FIG. 6, the resilient member 84*a* of the inner gear 84 is resiliently deformed, i.e., is repeatedly compressed and recovered such that only the inner gear 84 is rotated with the rotary shaft 41 in the 'B' direction. That is, the resilient member 84*a* overcomes the friction between the resilient member 84*a* and the groove 85*a* of the outer gear 85 and is moved to the next groove 85*a* repeatedly. When the cover member 70 is forcedly opened such that the load toward the inner gear 84 is stronger than the friction between the resilient member 84*a* and the groove 85*a*, the inner gear 84 is rotated. Accordingly, the pick-up roller 40 can be rotated normally, and it becomes possible to prevent damage to the various parts when the load of reverse directionality occurs.

That is, due to the presence of the main gear 83 serving as a clutch, the cover member 70 is automatically closed. Also, the stability of the product can be achieved by preventing the deformation of the cover member 70 and the damage to the internal parts when the cover member 71 is forcedly opened.

The paper cartridge of the printing apparatus according to the embodiment of the present invention as described above prevents the paper from being contaminated with foreign material such as dust due to the presence of the cover member 70 to cover the paper stacked on the pressure plate 30.

Also, when the cover member 70 is opened to stack the paper, the cover member 70 can be automatically closed by the driving force of the pick-up roller 40, and accordingly, the paper can be picked up normally by contacting the pick-up roller 40 with a predetermined pressure.

Also, when the cover member 70 is forcedly opened with the pick-up roller 40 rotating, transmission of the driving force of the pick-up roller 40 to the cover member 70 is prevented such that damage to the parts and deformation are prevented.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A paper cartridge for a printing apparatus to print on paper, comprising:

a cartridge body;

a pressure plate to move upward and downward in the cartridge body, the paper being stacked thereon;

a pick-up roller to pick up the paper stacked on the pressure plate;

a spring to elastically bias the pressure plate toward the pick-up roller;

a claw unit to support a front end of the paper stacked on the pressure plate and to separate the paper picked up by the pick-up roller sheet by sheet;

a cover member pivotably disposed at the cartridge body to cover the paper stacked on the pressure plate, to prevent the paper from being contaminated with a foreign material;

an association movement unit through which the cover member and the claw unit are moved in association with each other, the association movement unit to separate the pressure plate from the claw unit to allow the paper to be stacked on the pressure plate; and an automatic driving unit to automatically close the cover member when the pick-up roller is driven with the cover member being opened, to thereby return the pressure plate and the claw unit together.

2. The paper cartridge claim 1, wherein the cover member includes a pivot shaft, and the automatic driving unit comprises:

a first pivot lever disposed at the pivot shaft of the cover member and to rotate with the pivot shaft, to selectively press and move the pressure plate downward, the first pivot lever having gear teeth formed along an external circumference thereof;

an idle gear rotatably disposed at the cartridge body and selectively engaged with the gear teeth of the first pivot lever depending on a rotation position of the first pivot lever; and a main gear to transmit a driving force of the pick-up roller to the idle gear.

3. The paper cartridge of claim 2, wherein the main gear serves as a clutch to selectively block the driving force of the pick-up roller from being transmitted to the idle gear when a torque occurs in the idle gear to cause the idle gear to rotate in an opposite direction to a rotation direction of the pick-up roller.

4. The paper cartridge of claim 3, wherein the pickup roller comprises a rotary shaft and the main gear comprises:

an inner gear connected to the rotary shaft of the pick-up roller; and an outer gear connected to an outer side of the inner gear and engaged with the idle gear, wherein the inner gear and the outer gear are rotated together with each other due to a friction occurring therebetween, or only the inner gear is rotated when the outer gear is subject to a torque which is greater than the friction, thereby preventing the driving force from being transmitted to the idle gear.

5. The paper cartridge of claim 4, wherein:

the outer gear has a groove formed along an inner circumference thereof, a curvature radius of the groove repeatedly increasing and decreasing, and the inner gear has a resilient member resiliently deformed by contact with the groove when the inner gear rotates, and due to a friction occurring between the resilient member and the groove, the inner gear and the outer gear are rotated with each other.

6. The paper cartridge of claim 2, wherein the gear teeth of the first pivot lever are engaged with the idle gear when the cover member is opened and the gear teeth are disengaged from the idle gear when the cover member is closed.

7. A paper cartridge for a printing apparatus to print on paper, comprising:

a cartridge body;

a pressure plate to move upward and downward in the cartridge body, the paper being stacked thereon;

a pick-up roller to pick up the paper stacked on the pressure plate;

a spring to elastically bias the pressure plate toward the pick-up roller;

a claw unit to support a front end of the paper stacked on the pressure plate and to separate the paper picked up by the pick-up roller sheet by sheet; and a cover member pivotably disposed at the cartridge body to cover the paper stacked on the pressure plate, to prevent the paper from being contaminated with a foreign material, wherein the cover member includes a pivot shaft, and the association movement unit comprises:

a first pivot lever connected to the pivot shaft of the cover member to rotate with the pivot shaft, and to move the pressure plate downward by contacting the pressure plate when the cover member is opened; and a second pivot lever pivotably disposed at the cartridge body, to rotate in contact with the downward moving pressure plate and to push the claw unit upward to thereby separate the pressure plate from the claw unit.

8. A paper cartridge for a printing apparatus to print on paper, comprising:

a plate to move in a first and a second direction, the paper being stacked thereon;

a roller to pick up the paper stacked on the plate;

a cover to cover the paper stacked on the plate in a first position of the cover, the paper not being covered by the cover in a second position of the cover;

a separator to separate the paper picked up by the roller sheet by sheet, the separator being in contact with the plate in the first position of the cover and being separated from the plate in the second position of the cover; and an automatic driving unit to automatically move the cover to the first position when the roller is driven with the cover in the second position.

9. The paper cartridge of claim 8, further comprising a bias unit to bias the plate towards the roller.

10. The paper cartridge of claim 8, wherein the cover includes a pivot shaft, and the automatic driving unit comprises:

a first pivot lever disposed at the pivot shaft of the cover and to rotate with the pivot shaft, to selectively press and move the plate in the first direction, the first pivot lever having gear teeth formed along an external circumference thereof;

an idle gear rotatably selectively engaged with the gear teeth of the first pivot lever depending on a rotation position of the first pivot lever; and a main gear to transmit a driving force of the roller to the idle gear.

11. The paper cartridge of claim 10, wherein the gear teeth of the first pivot lever are engaged with the idle gear when the cover is in the second position and the gear teeth are disengaged from the idle gear when the cover is in the first position.

12. A paper cartridge for a printing apparatus to print on paper, comprising:

a plate to move in a first and a second direction, the paper being stacked thereon;

a roller to pick up the paper stacked on the plate;

a cover to cover the paper stacked on the plate in a first position of the cover, the paper not being covered by the cover in a second position of the cover;

a separator to separate the paper picked up by the roller sheet by sheet, the separator being in contact with the plate in the first position of the cover and being separated from the plate in the second position of the cover a pivot shaft connected to the cover; and a movement unit, comprising:

a first pivot lever connected to the pivot shaft to rotate with the pivot shaft, and to move the plate in the first direction by contacting the plate when the cover is moved to the second position, and a second pivot lever to rotate in contact with the plate moving in the first direction and to push the separator in the second direction to thereby separate the plate from the separator.

13. A printing apparatus to print on paper, comprising:

a body;

a paper cartridge, disposed in the body, comprising:

a plate to move in a first and a second direction, the paper being stacked thereon, a roller to pick up the paper stacked on the plate, a cover to cover the paper stacked on the plate in a first position of the cover, the paper not being covered by the cover in a second position of the cover, and a separator to separate the paper picked up by the roller sheet by sheet, the separator being in contact with the plate in the first position of the cover and being separated from the plate in the second position of the cover; and an association movement unit through which the cover member and the claw unit are moved in association with each other, the association movement unit to separate the pressure plate from the claw unit to allow the paper to be stacked on the pressure plate; and an automatic driving unit to automatically close the cover member when the pick-up roller is driven with the cover member being opened, to thereby return the pressure plate and the claw unit together.

* * * * *

UNITED STATES PATENT AND TRADEMARK OFFICE

CERTIFICATE OF CORRECTION

PATENT NO. : 6,953,190 B2
APPLICATION NO. : 10/393427
DATED : October 11, 2005
INVENTOR(S) : Hwa-sung Shin It is certified that error appears in the above-identified patent and that said Letters Patent is hereby corrected as shown below:

Column 7,
Line 36, after "cartridge" insert -- of --;
Line 56, replace "pickup" with -- pick-up --.

Signed and Sealed this

Fourth Day of July, 2006

JON W. DUDAS
*Director of the United States Patent and Trademark Office*